United States Patent [19]

Barletta et al.

[11] Patent Number: 4,919,847

[45] Date of Patent: Apr. 24, 1990

[54] PROCESS FOR MANUFACTURING PARTICULATE DETERGENT COMPOSITION DIRECTLY FROM IN SITU PRODUCED ANIONIC DETERGENT SALT

[75] Inventors: Gualtiero Barletta; Antonio Bianchi, both of Rome, Italy

[73] Assignee: Colgate Palmolive Co., Piscataway, N.J.

[21] Appl. No.: 202,773

[22] Filed: Jun. 3, 1988

[51] Int. Cl.[5] ..... C11D 1/22; C11D 11/04; C11D 13/10

[52] U.S. Cl. ..... 252/558; 252/174.13; 252/174.14; 252/174.25; 252/530; 252/539; 252/549; 427/212; 427/215

[58] Field of Search ..... 252/174.13, 91, 531, 252/539, 550, 558; 260/505 N; 23/313 R; 427/212, 215

[56] References Cited

U.S. PATENT DOCUMENTS

| | | | |
|---|---|---|---|
| 3,472,784 | 10/1969 | Poe | 252/558 |
| 3,597,361 | 8/1971 | Sumner | 252/558 |
| 3,769,222 | 10/1973 | Yurko et al. | 252/174.13 |
| 4,141,316 | 2/1979 | Grun | 118/303 |
| 4,515,707 | 5/1985 | Brooks | 252/368 |
| 4,544,493 | 10/1985 | Silvis | 252/89.1 |
| 4,734,224 | 3/1988 | Barrett et al. | 252/558 |
| 4,759,865 | 7/1988 | Malihi | 252/175 |
| 4,828,721 | 5/1989 | Bollier et al. | 252/8.7 |
| 4,888,972 | 12/1984 | Weinstein | 252/8.6 |

FOREIGN PATENT DOCUMENTS

| | | |
|---|---|---|
| 72999 | 4/1985 | Japan . |
| 1404317 | 8/1975 | United Kingdom . |

*Primary Examiner*—Prince E. Willis

*Attorney, Agent, or Firm*—Bernard Lieberman; Murray M. Grill; Robert C. Sullivan

[57] ABSTRACT

A particulate detergent composition, such as one comprising sodium linear higher alkylbenzene sulfonate (LAS) and bentonite, is made directly from anionic synthetic organic detergent acid by neutralizing such acid with a neutralizing agent, such as aqueous sodium hydroxide solution, in a reaction vessel and directly discharging the neutralized detergent salt from the reaction vessel into an absorption zone wherein globules of the anionic detergent salt, in aqueous solution or dispersion, and particulate solid carrier particles are rapidly circulated and repeatedly brought into contact with one another to produce detergent salt-carrier composition particles or agglomerates. In preferred aspects of the invention the bentonite will be admitted exteriorly to the neutralized detergent salt solution in an absorption zone so as to prevent contact with the walls of such zone of the aqueous solution or dispersion of detergent salt, and the detergent salt-carrier composition will be directly delivered to an agglomerator, granulator or tumbling drum, and the composition will be converted to particles of desired sizes.

Also within the invention are apparatuses that are useful in carrying out the described processes. Additionally, instead of employing aqueous or liquid neutralizing agents, powdered solids may be used, in which case the neutralization and absorption functions may take place in the same zone and be effected by the same materials, such as alkaline builders, e.g., sodium carbonate.

11 Claims, 3 Drawing Sheets

Figure 1:
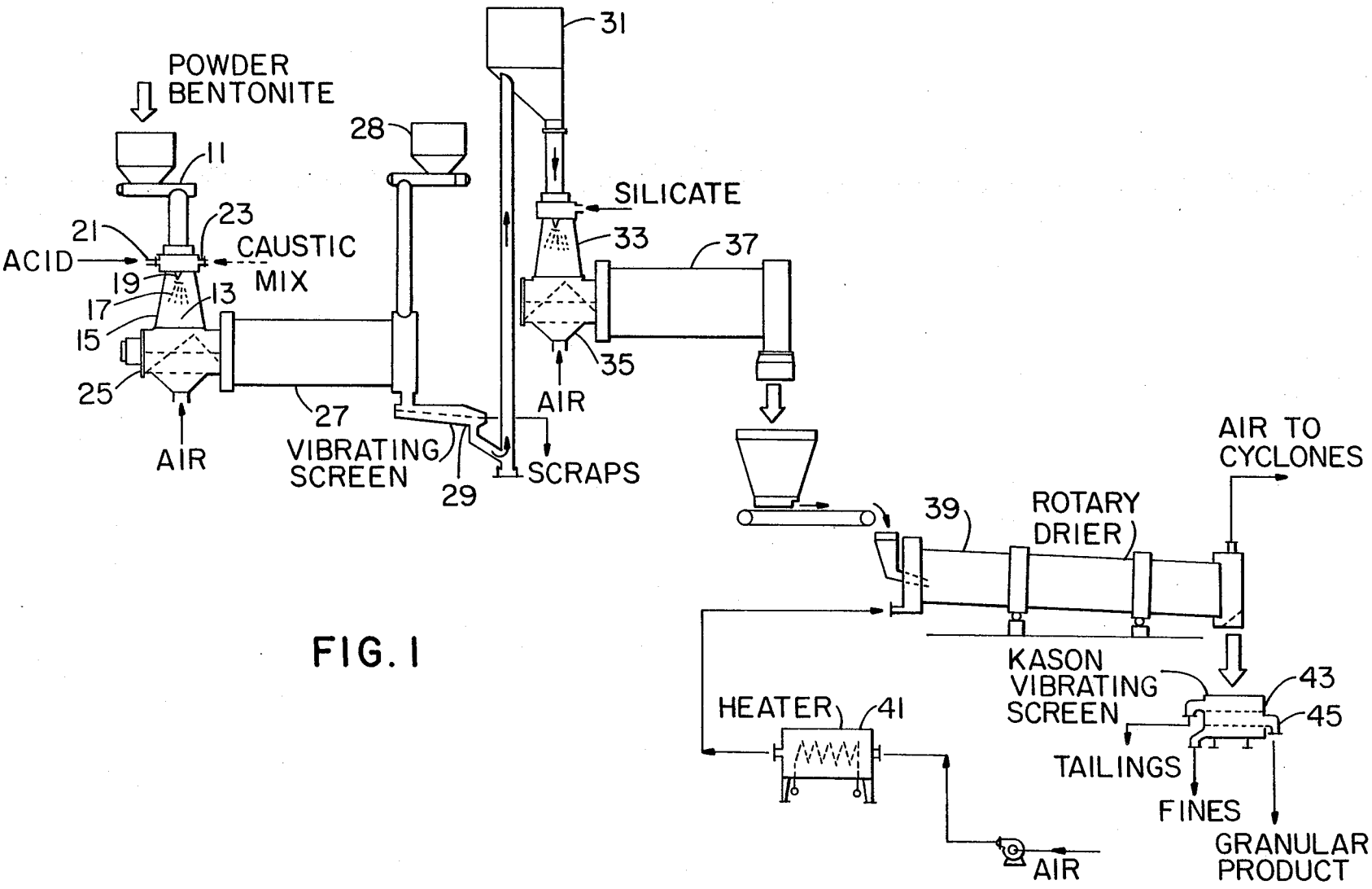

PROCESS FOR MANUFACTURING PARTICULATE DETERGENT COMPOSITION DIRECTLY FROM IN SITU PRODUCED ANIONIC DETERGENT SALT

This invention relates to a process for manufacturing particulate detergent compositions directly from in situ produced anionic detergent salt. More particularly, it relates to manufacturing sodium linear alkylbenzene sulfonate (LAS)/carrier (bentonite) detergent compositions, which are useful components of high bulk density particulate built detergent compositions, by reacting a corresponding anionic detergent acid with an aqueous solution of neutralizing agent and, without intermediate separation and/or purification operations, absorbing the liquid/paste state detergent solution made onto carrier particles, such as powdered bentonite. Subsequently, such particles or agglomerates thereof, in which the anionic detergent is absorbed into the bentonite, may be (further) agglomerated and converted to particles of desired sizes so as to blend well with spray dried or other base builder particles. Also within the invention are apparatuses for effecting the described processes, and modifications of the processes wherein powdered builder salts may be employed as neutralizing agents instead of aqueous neutralizing solutions.

In the manufacture of synthetic anionic organic detergents, such as sodium salts of lipophile sulfuric and sulfonic acids, neutralization is conventionally effected with aqueous solutions of neutralizing agents, such as aqueous sodium hydroxide, but for "dry" neutralizations powdered alkaline salts, such as sodium carbonate and sodium bicarbonate, have also been employed The detergent acid being neutralized may contain sulfating or sulfonating agent or byproducts thereof, such as sulfuric acid, so in the neutralization reactions sodium sulfate will often be produced, which may be separated from the detergent acid by solvent extraction, followed by evaporation off of the solvent, which is often ethanol or isopropanol. Alternatively, the detergent acid may be purified of sulfuric acid before neutralization, or such purification needs not be effected.

The neutralized detergent salt may be dried and thereafter incorporated in detergent compositions or, without preliminary drying, a solution or dispersion of such salt may be mixed with other components of a desired final detergent composition, in a mixer or crutcher, and the aqueous slurry resulting may be spray dried. Unfortunately, due to the presence of the anionic detergent in such crutcher mixes the spray dried beads resulting tend to be of lower bulk density than is often desired, making the product ill suited for manufacturing "concentrated" particulate detergent compositions and particulate built detergent compositions intended for automatic dispensing into automatic washing machines. However, it has recently been discovered that comparatively high bulk density built particulate anionic synthetic organic detergent compositions can be made by spray drying or otherwise manufacturing high bulk density base builder beads, particles or globules, with little organic material present and no anionic synthetic organic detergent, and mixing them with an agglomerate of anionic detergent and inorganic carrier for it, such as bentonite. Such processes and products have been described in U.S. Pat. applications Ser. Nos. 07/187,102 and 07/187,103 entitled Particulate Fabric Softening Detergent Compositions and Manufacturing Processes, and Process for Manufacturing High Bulk Density Particulate Fabric Softening Synthetic Anionic Organic Detergent Compositions, respectively, both of which were filed on Apr. 28, 1988, and both of which are hereby incorporated herein by reference. Ser. No. 07/187,102 has issued as U.S. Pat. No. 4,824,721 and Ser. No. 07/187,103 has been allowed.

Although neutralization of detergent acid with aqueous neutralizing agent and making of a detergent composition by agglomerating LAS and bentonite have been described in the mentioned patent applications, prior to the present invention it was not known to neutralize detergent acid (or detergent acid containing excess sulfuric acid) with a neutralizing agent, and directly (immediately thereafter) to convert the resulting detergent salt solution to a particulate product by absorbing it on carrier particles, such as on bentonite powder. Also, it was not known to agglomerate such detergent salt-carrier particles into beads of the same size as the preferred spray dried inorganic builder salt base beads so as to make high bulk density built particulate detergent compositions.

In accordance with the present invention a process for manufacturing a particulate detergent composition comprises reacting an anionic synthetic organic detergent acid with a neutralizing agent for it in a reaction vessel in sufficient proportion to produce a corresponding neutralized detergent salt in liquid state, removing the neutralized detergent salt from the reaction vessel, and directly contacting such detergent salt, in an absorption zone, with a particulate carrier for it and producing a detergent salt-carrier composition in particulate form. Also within the invention are apparatuses in which the processes may be carried out. Additionally, in some instances neutralization may be with powdered alkaline builder salt, such as sodium carbonate.

Figure 2:
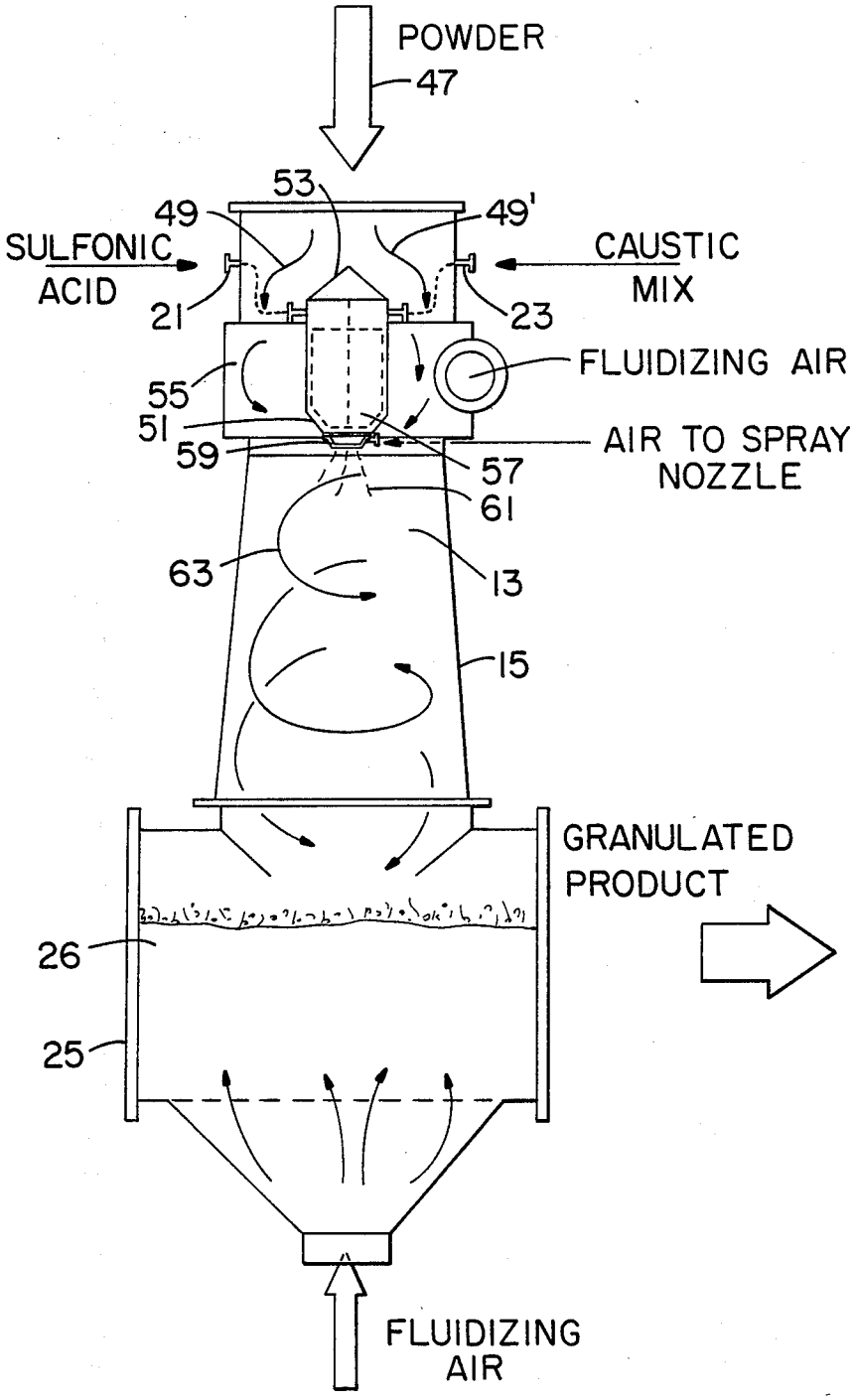
Figure 3:
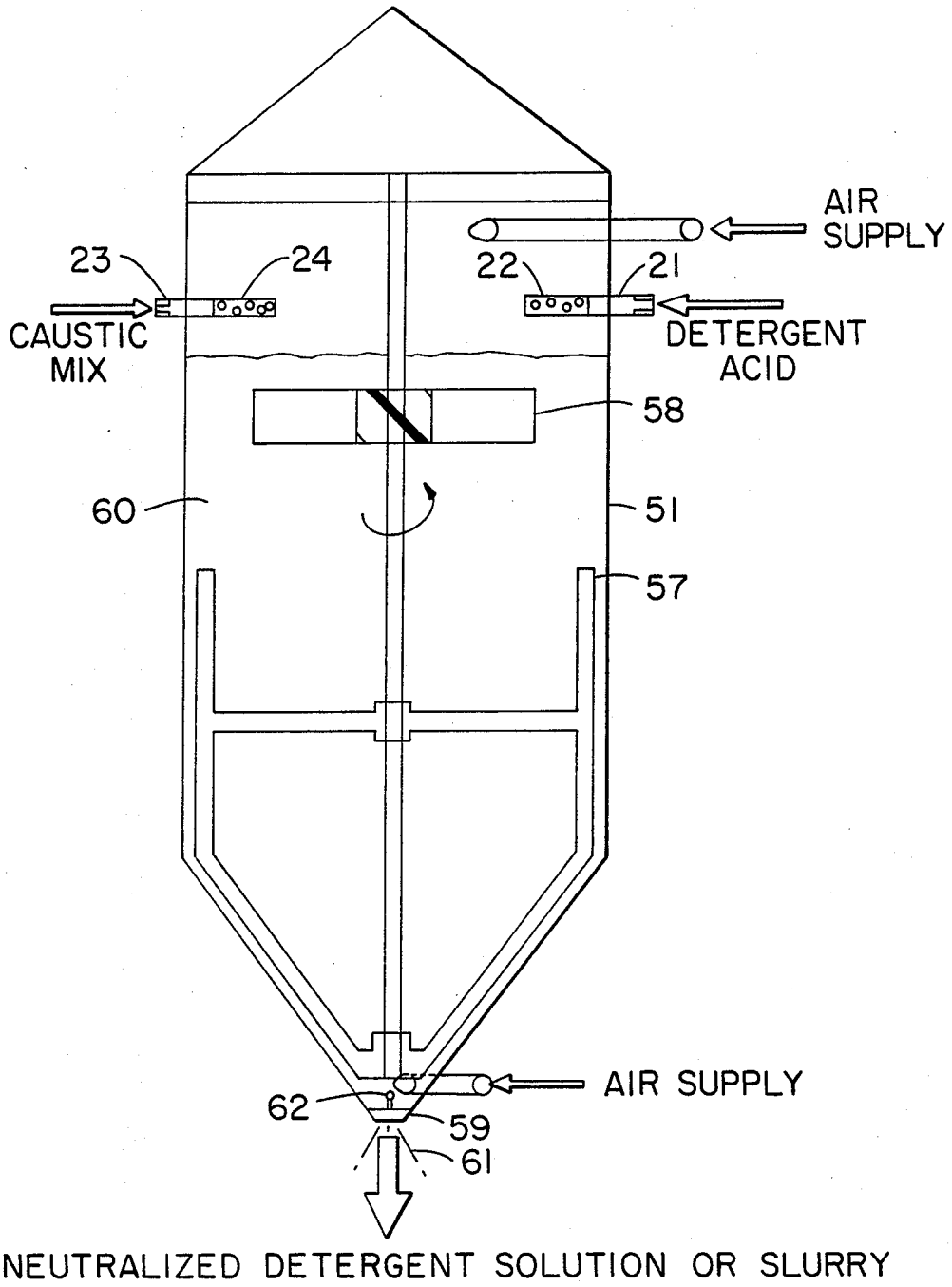

The invention will be readily understood by reference to the accompanying drawing in which:

FIG. 1 is a schematic diagram illustrating a process of the present invention in which powdered carrier (bentonite) is mixed with in situ-made neutralized detergent salt, with the particulate bentonite/LAS detergent composition being subjected to mixing and at least partial agglomeration in a fluidized bed, after which it is mixed with other final detergent composition component(s), screened, treated with binder (silicate) to harden the particles, and dried;

FIG. 2 is a schematic and partially cutaway view of a first (upstream) portion of the equipment of FIG. 1; and FIG. 3 is a cutaway view of the reactor of FIG's. 1 and 2, wherein detergent acid and neutralizing solution are reacted.

In FIG. 1 powder feeder 11 feeds carrier powder, such as bentonite, through a passageway external to a reactor, which is illustrated in FIGS. 2 and 3, into absorption zone 13 bounded by wall 15, into which in situ neutralized detergent salt solution or slurry 17 is being sprayed through nozzle 19. Sulfonic acid and caustic mix (neutralizing solution) are shown passing through lines 21 and 23, respectively, into the reactor, which is not shown in FIG. 1. In the absorption zone 13 the bentonite powder and the neutralized detergent solution, in droplet form, are both maintained suspended and in vigorous motion by air which is admitted to such zone, as from fluidized bed mixer-agglomerator 25. From such fluidized bed, which performs some agglomerating of the bentonite and LAS solution, the at least partially agglomerated product passes to rotating horizontal drum agglomerator 27. Additional components of the desired final composition may be added via powder charger 28, and liquid components may also be added, and such additions may be more upstream, if desired Oversized particles may be screened out by vibrating screen 29 and product taken off may be delivered to centrifugal separator 31 for removal of undersized particles and dusts. The off-specification material may be reworked in a suitable part of the process, as by addition to mixer-agglomerator 25 (the oversized particles may be crushed before such reworking), and the on-specification particles may be passed through another absorption chamber 33, in which a solution of binder may be sprayed onto such particles which, together with globules of such solution, are held in moving suspension by air passing upwardly through fluidized bed 35. The treated particles may be further agglomerated in rotating horizontal drum 37 and then may be dried in rotary dryer 39, or in some cases they may be dried directly (when no further agglomeration is desired) immediately after fluidized bed 35. As illustrated, the dryer employed dries by means of hot air, which is heated in heater 41, which air passes out of the system through a cyclone or a centrifugal separator, from which fines are recovered and are reworked. The product exiting the rotary dryer is screened in Kason vibrating screens 43 and the desired agglomerate is removed through exit 45, with tailings and fines being removed and reworked.

As illustrated, the process employed is a continuous one but semi-continuous or batch processes may also be practiced. However, in all such cases it is important that to obtain the full advantages of the invented process the absorption by the carrier particles of the recently in situ neutralized detergent acid should occur promptly, which allows the detergent to be used when hot and fluid, and which avoids objectionable hydrolysis of the detergent, which could otherwise take place Among other desirable features of the invention is the utilization of fluidized bed air to maintain the neutralized detergent globules and carrier particles in free suspension and movement until the detergent is absorbed by the particles, which may become partially agglomerated in the absorption zone. Such air flow and the surrounding of the sprayed globules of neutralized detergent salt by the carrier in the absorption zone prevent or significantly limit any contact of liquid detergent solution with the zone walls, which helps to avoid hydrolysis and degradation of the detergent, lumping and production of heterogeneous compositions. The fluidized bed air and the carrier powder also help to cool the detergent salt solution. Similarly, objectionable "hot spots" in the solution or slurry are prevented, which hot spots could occur due to uneven neutralization rates or due to incomplete neutralizations.

In FIG. 2 the addition of bentonite powder or other carrier powder to the system is represented by arrow 47. Arrows 49 and 49' show the path of the bentonite about reaction vessel 51 and conical cap 53 atop such vessel. A fluidized bed 55 of bentonite surrounds reactor 51 and, as indicated by the three arrows, the bentonite flows downwardly from such bed or fluidized volume to absorption zone 13. In reactor 51 lower mixing blade 57 maintains the reaction mix in motion so as to keep the reaction temperature as constant as possible, and neutralized product is continuously withdrawn and sprayed through air operated spray nozzle 59 in spray 61 into absorption zone or chamber 13. Arrows 63 indicate the air flow pattern and represent carrier particles preventing liquid spray 61 from contacting the frustoconical wall 15 of the absorption chamber. Charge rates of bentonite, detergent acid and neutralizing agent, together with air flow rates, are so regulated as to have the carrier/LAS particles that are to be removed from the absorption zone agglomerated to the desired extent and of the desired size, at that stage. The LAS/carrier particles drop to fluidized bed apparatus 25 and form a working fluidized bed 26 therein, the air from which bed proceeds upwardly into absorption chamber 13. Such air may be removed from the system at any convenient higher location. Agglomerated or partly agglomerated product may be withdrawn from the fluidized bed (or from any other suitable mixer that may b substituted for it) when specified size and bulk density are reached, and may be hardened by binder treatment and/or dried, and mixed with other final detergent composition components, as desired.

In FIG. 3 reaction vessel 51 includes lower stirrer 57 and upper stirrer 58, which may be air powered and may be assisted in mixing reaction mix 60 by bubbling air through such mix. As illustrated, detergent acid enters through inlet 21 and neutralizing solution (aqueous sodium hydroxide) enters through inlet 23. In both cases the entrance streams are subdivided by heads 22 and 24 to promote more even distribution of reactants. Additions of reactants and takings off of product are regulated to promote complete reaction. The "heel" from which product is removed, is essentially neutral and contains very little, if any, of the reactants. The neutralized detergent, in slurry state (the temperature thereof, due to the heat of neutralization helps to maintain fluidity) is removed through outlet 62 and spray nozzle 59, and is discharged into absorption chamber 13 as spray 61.

The anionic synthetic organic detergent acid which is neutralized in the processes of this invention is one which can be converted by neutralization to a water soluble alkali metal salt, such as sodium salt, of the sulfonate type. Such acids may be characterized as alkylbenzene sulfonic acids. Such are preferably linear higher alkylbenzene sulfonic acids. Various anionic detergents corresponding to such acids are described in *Surface Active Agents and Detergents,* Vol. II, by Schwartz, Perry and Berch, published in 1958 by Interscience Publishers, Inc., which is incorporated herein by reference. Although the sulfonic acids are normally employed, it is also within the invention to utilize other anionic detergent acids, such as the higher fatty acyl sarcosines and higher fatty acyl isethiones. Usually the higher alkyl (or acyl) group of the anionic detergent acids is of 10 to 18 carbon atoms, preferably 12 to 15 carbon atoms, and the ethoxy contents of such detergent acids as are ethoxylated will preferably be in the range of 3 to 30 ethoxy groups per mole. In the highly preferred higher alkylbenzene sulfonic acid the higher alkyl lipophile will preferably be linear and of 12 to 13 carbon atoms or will be of average carbon atoms content in such range.

The neutralizing agent for the anionic detergent acid will usually be an alkaline alkali metal compound, such as sodium hydroxide or an alkaline sodium salt, of which salts sodium carbonate is preferred, although other sufficiently alkaline salts, which also may be builder salts, such as sodium bicarbonate, sodium silicate and sodium polyphosphates, may also be useful neutralizing agents.

Water insoluble carrier, with which the neutralized salt may be mixed and/or agglomerated immediately after neutralization of the detergent acid, may be any suitable material, including calcium carbonate, talc, clays and zeolites, but is preferably a functional material, which contributes its desirable properties to the detergent/carrier composition made or to an ultimate detergent composition incorporating such intermediate product. Thus, fabric softening clays, such as smectite clays of the montmorillonite type, e g., swelling bentonites, are the most preferred carriers. Others which perform useful functions in laundry detergent compositions including them are zeolites, which act as builders, silica (for scouring cleanser applications), talc (as a polishing agent), and calcium carbonate (also as a polishing agent). Usually the carrier will be water insoluble but sometimes it may be water soluble, such as when it functions as a soluble builder for the neutralized detergent salt, and in some such instances it may also act as a neutralizing agent, in supplementation of or in replacement of aqueous neutralizing agent solution.

The detergent acid to be neutralized may be in the form in which it results from sulf(on)ation of the lipophilic or hydrocarbyl base material, such as alkylbenzene. Normally, as when linear dodecylbenzene sulfonic acid is the detergent acid charged, the concentration of sulf(on)ic acid will be from 80 to 100%, with from 0 to 20% of sulfuric acid, 0 to 3% of free oil (unreacted or byproduct organic material) and 0 to 5% of water. A typical linear dodecylbenzene sulfonic acid may have from 85 to 95% of sulfonic acid, 5 to 9% of sulfuric acid and 1 to 2% of free oil, with any water content thereof being held to no more than 1% and preferably, to less than 0.5%. Such material will be in liquid state and pumpable so that it can be charged to the reaction vessel for neutralization Normally the temperature of the detergent acid, as charged, will be in the range of 40 to 60° C., which aids in maintaining it fluid.

The neutralizing agent, which is preferably aqueous sodium hydroxide solution, will normally be of sodium hydroxide concentration as high as feasible, usually being over 40% and normally in the range of 40 to 50%, by weight, preferably being about 49% or 50% sodium hydroxide, which corresponds to about 38% of $Na_2O$. When other neutralizing agents are employed the concentrations thereof will also be as high as feasible, while still maintaining fluidity so as to promote neutralization without localized degradations of the detergent.

The proportions of reactans employed will be approximately atoichiometric, although in some cases, as when aqueous solutions of alkaline builder salts are used as neutralizing agents, excesses thereof may be employed, usually about 10%. Of course, such stoichiometric proportions and excesses are calculated on the basis of the total acidity of the detergent acid charged, including any other acidic materials present therein, such as sulfuric acid, which results from excess sulfonating agent being employed in the sulfonation reaction The neutralized detergent made in the reaction vessel will normally be from 50 to 80% active detergent component, often being from 60 to 75% thereof, Other materials present with the detergent will be sodium sulfate, byproduct free oil, water and, in rare cases, unreacted detergent acid and/or unreacted neutralizing agent. Such product will be fluid and will be capable of being sprayed through spray nozzles from the reaction vessel to the absorption zone. Normally, the temperature of such slurry/solution will be in the range of 50 to 100° C., to help maintain fluidity.

Bentonite and the other particulate carriers previously mentioned may be in any suitable particulate form and of any suitable size but usually the particle sizes will be no larger than No. 140 sieve (U.S. Sieve Series) initially and it is preferred, at least for bentonite and any other clays which may be employed, that the particles thereof will be small enough to pass through a No. 200 sieve, and more preferably through a No. 325 sieve. Swelling and fabric softening bentonites of such particle sizes are available from various manufacturers and processors, including Industria Chimica Carlo Laviosa, American Colloid Company, Industrial Division, and Georgia Kaolin Company, and some suitable bentonites of such companies are sold under the Laviosa AGB, American Colloid and Mineral Colloid designations, respectively.

The detergent/carrier product from the absorption zone will normally comprise 5 to 40% of the anionic synthetic organic detergent and 50 to 95% of carrier, and the ratio of neutralized detergent salt, such as sodium LAS, to carrier, such as bentonite, will usually be in the range of 1:3 to 1:4, but such range may be extended to 1:3 to 1:8. There may also be present 0 to 20% of binder, adjuvants and water, which may be added to the absorption zone with the carrier or subsequently. The particulate product leaving the absorption zone is desirably in the size range of 8 to 120 sieves and is of a bulk density of at least 0.5 g./cc., but may be of sizes in the 10 to 100 sieves range and of bulk density of 0.6 to 0.7 g./cc. However, particles of smaller sizes and lower bulk densities may be made in the absorption zone and may be subsequently agglomerated to the desired size and density ranges. Preferred agglomerates which have been simultaneously or subsequently hardened by binder treatment, using sodium silicate or an organic polymer solution include 50 to 70% of bentonite, 20 to 35% of detergent salt, 5 to 10% of sodium silicate (or other binder) and the balance, normally 2 to 10%, of sodium sulfate and other materials that may accompany the detergent. Such percentages are on a dry basis and the proportion of moisture may be in the range of 1 to 15%, but usually will be 1 to 5%.

In the invented apparatus the reaction vessel and absorption zone are preferably coaxially positioned with the reaction product being discharged from the bottom of the reaction vessel into the top of the absorption zone and being sprayed in droplet form into such zone, while bentonite or other carrier powder is swirled about, on the "exterior" of such spray pattern. Thus, the detergent solution or slurry and the bentonite are both in finely divided form to facilitate production of uniform particles and to promote absorption of the liquid into the bentonite, with resulting agglomeration (at least partial). The product, being heavier than the circulating bentonite particles, falls to the fluidized bed or other mixer or agglomerator which is located below the absorption zone, and may be further agglomerated therein. Air or other suitable gas, from the fluidized bed, passes into the absorption zone and helps to maintain the motion of the particles and droplets therein As it has been described, the process is continuous, which is one of its significant advantages, but it will be apparent that it may be adapted to semi-continuous and batch operations, too.

In variations of the process other mixer-agglomerators than the fluidized bed unit illustrated may be employed. The fluidized bed mixer illustrated in the drawing may be of the O'Brien agglomerator, V-blender, horizontal rotating drum, or Aeromatic fluidized bed types but it has recently been found that a VOMM Turbo-Dryer, which also acts as a mixer and a granulator, may desirably be used, with or without a VOMM Turbo-Mixer, and such equipment may be employed in the manner described in the second of the U.S. Pat. applications previously referred to herein. In another variation of the invention the reaction vessel may be employed as a mixer for detergent acid and such may be sprayed onto neutralizing alkaline builder particles in the absorption zone.

The various products of the invention may be made in desired particle size ranges previously mentioned, especially 10 to 100 sieves, relatively easily, and the product has the additional advantage of being of comparatively high bulk density, preferably in the range of 0.6 to 0.7 g./cc., which is not obtainable when crutcher mixes containing anionic detergent are spray dried. Thus, the product may be blended with spray dried base beads composed largely of inorganic builder salt, such as sodium tripolyphosphate, to produce a high bulk density built particulate anionic detergent composition. Alternatively, the product may be utilized alone or in other detergent compositions.

Various advantages of the invention over prior art methods and apparatuses have been referred to previously and so will not be repeated here in detail However, it will be apparent that the apparatus provided is integrated and coacting, with feed rates and product properties being readily controllable. Also, product degradation is minimized, there is little waste, heat is conserved, and wall build-ups are minimized. Most important, however, an efficient method is described in which high bulk density fabric softening anionic detergent particles are readily manufactured, which particles are attractive in appearance, free flowing and non-caking, on storage.

The following examples illustrate but do not limit the invention. Unless otherwise indicated, all parts are by weight in these examples, in the specification and in the claims, and all temperatures are in °C.

EXAMPLE 1

Utilizing the apparatus illustrated in FIGS. 1–3, stoichiometric proportions of linear dodecylbenzene sulfonic acid and sodium hydroxide solution are fed to a reaction vessel (51) through spray lines (21 and 23) and are reacted in the vessel, under agitation, to produce neutralized detergent salt, sodium linear dodecylbenzene sulfonate. The sulfonic acid charged includes 91% of linear dodecylbenzene sulfonic acid, 7% of sulfuric acid, 1.5% of free oil (unreacted hydrocarbon) and 0.5% of water, and the sodium hydroxide solution is 49% of NaOH, with the balance being water. Thus, 34.1 kg. of the caustic solution are employed to stoichiometrically neutralize 100 kg. of the sulfonic acid, as charged, which was that resulting from oleum sulfonation of the hydrocarbon. As a result of the neutralization reaction there are produced 96.1 kg. of sodium linear dodecylbenzene sulfonate, 10.1 kg. of sodium sulfate and 7.6 kg. of water (in addition to the 0.5 kg. of water that was charged with the sulfonic acid and the 11.5 kg. of water with the sodium hydroxide solution). The hold-up time in the reaction vessel is about 20 seconds and the reaction temperature is maintained at about 90° C. The neutralized product made is continuously withdrawn from the heel thereof as reactants are added. Such neutralized product, at such elevated temperature (90° C.) is in liquid state and includes about 70% of sodium linear dodecylbenzene sulfonate (although the theoretical percentage thereof is closer to 76%). If desired, to thin the mix so as to promote better mixing and spraying into the absorption zone or chamber, the mix may be diluted, preferably with water, as by employing a more dilute caustic for neutralization. The neutralized detergent, in liquid state, is then sprayed into the absorption zone through a spray nozzle to produce small globules thereof, normally of particle sizes less than one mm. and preferably less than 0.5 mm. in diameter. Such spraying, as indicated in the drawing, is essentially axially and downwardly and outwardly into a shroud of carrier particles, which, with the detergent solution globules, are being rapidly moved in a circular path inside the absorption zone, and which prevent contact of the liquid detergent with the zone walls.

The carrier powder, which is a Laviosa bentonite identified as Detercol P2, is fed around the reaction chamber, as indicated in the drawing, into a fluidized bed (55), from which it is discharged into the absorption chamber, peripherally and exteriorly with respect to the spray of neutralized detergent solution globules. The detergent globules adhere to the bentonite particles while both such components are kept in motion in moving air and the mixed product then exits. In rotary drum 27, or suitable fluidized bed the mix and/or agglomerate produced in the absorption zone is further mixed, conditioned and/or agglomerated. The hold-up time in the absorption zone is about five minutes. From the absorption zone the LAS-bentonite particles are passed to means for hardening them by spraying binder solution thereon and thence are sent to a dryer, as illustrated in the drawing. Subsequently, as further illustrated, the product is screened, and off-specification materials are returned to the absorption zone, with any oversized particles being size-reduced first.

The dried product contains 59.7% of bentonite, 8% of sodium silicate, and 26% of sodium linear dodecylbenzene sulfonate, with 5.3% of other materials (sodium sulfate and free oil), on a dry basis, and is of a moisture content of about 4%. After cooling, it is mixed in a proportion of 1:3 with spray dried builder base bead composition to produce a final particulate built anionic synthetic organic detergent composition. The LAS/-bentonite agglomerate is of particle sizes in the range of 10 to 80 sieves and of a bulk density of about 0.5 g./cc. and the builder beads are of a bulk density of about 0.6 g./cc. and particle sizes in the same 10 to 80 sieves range. The builder composition beads comprise about 50% of sodium tripolyphosphate, about 5% of sodium silicate, about 25% of sodium sulfate, about 15% of water and about 5% of adjuvants, included among which are fluorescent brightener, perfume, antioxidant, enzyme and colorant. A more detailed description of such builder beads may be found in the first of the two patent applications previously mentioned in this specification.

When tested, both the LAS/bentonite agglomerate and the built detergent are found to be attractive in appearance, free flowing, non-caking and non-segregating They are both suitable for automatic dispensing from dispensing units of automatic washing machines, and also for sale as satisfactory concentrated particulate detergent compositions. They washed soiled laundry effectively and the bentonite acts as a useful fabric softening component, which softens laundry to the touch.

The equipment employed may be easily operated and controlled by one man, and production is carried on with few operational problems being encountered. The bentonite is an effective absorbent for the liquid detergent that is sprayed into the absorption zone, and it prevents caking of such liquid on the zone walls.

In variations of the procedure described the product from the absorption chamber is delivered directly to a turbomixer and from it to a trubodryer, which performs functions of shaping beads to golublar forms, and drying them. Also, instead of feeding a mixer, the absorption column product may be delivered directly to a turbogranulator or to other suitable equipment for producing desired agglomerate.

EXAMPLE 2

The equipment of Example 1 is employed but the materials charged are changed. Thus, instead of using only bentonite as the carrier, the bentonite is mixed with an equal proportion of sodium carbonate, with the total proportion of carrier being the same. Also, carbonate may be used in stoichiometric proportion in solution, in replacement of the caustic, to neutralize the detergent acid. The bentonite contributes its fabric softening and carrier properties whereas the carbonate acts as a builder for the anionic detergent, and as a carrier, or as a neutralizing agent, when it is preferably in excess, e.g., 30% in excess. In making the built detergent composition from the products of these processes by mixing with builder base beads, the same proportions of builder beads : agglomerate are employed and the results are that the built detergent compositions made include more builder (carbonate). However, they have other desirable properties of the compositions that were mentioned in Example 1, (except lowered fabric softening when less bentonite is present).

EXAMPLE 3

In a further modification of the processes of this invention 23 parts of the sulfonic acid of Example 1 are mixed in "reactor" (51) and are sprayed into the absorption zone, wherein they impinge on swirling sodium carbonate particles of size less than 140 sieve, with the proportion of sodium carbonate to sulfonic acid being 77:23. The sulfonic acid (and the accompanying sulfuric acid) is neutralized by the sodium carbonate, producing detergent salt, carbon dioxide, sodium bicarbonate and water, and leaving some of the carbonate unreacted. The effluent from the absorption zone is mixed, agglomerated and dried according to the method previously described in Examples 1 and 2, and the product is found to be satisfactory for mixing with spray dried base builder beads to make high bulk density built particulate detergent compositions.

EXAMPLE 4

In foregoing Example 1, instead of employing the Turbodrymex-type plant illustrated in FIG. 1, the effluent from the absorption chamber is passed directly to a VOMM Turbodryer. The product resulting is even higher in bulk density, with a bulk density as high as 0.9 g./cc. being attainable. Instead of utilizing the Turbodryer only a VOMM Turbomixer may be interposed between the absorption chamber and the Turbodryer, with essentially the same type of product resulting.

EXAMPLE 5

The processes described in Examples 1–4 are varied in proportions ±10%, ±20% and ±30%, while maintaining said proportions in the ranges previously mentioned. The processes proceed satisfactorily and the products are acceptable. In other variations of the invention, instead of linear dodecylbenzene sulfonic acid being employed, linear tridecylbenzene sulfonic acid is used and in still other processes other anionic detergents, including lauryl sulfuric acid and paraffin sulfonic acids are substituted for the alkylbenzene sulfonic acids, with process conditions being changed accordingly, within the ranges previously mentioned in this specification. Such processes proceed satisfactorily and the products are acceptable as particulate anionic detergent compositions or as components of high bulk density particulate built anionic detergent compositions.

The invention has been described with respect to examples and illustrations thereof but is not to be limited to these because it is evident that one having access to the present specification will be able to utilize substitutes and equivalents without departing from the teachings thereof and without going outside the present invention.

What is claimed is:

1. A process for manufacturing a particulate detergent composition which comprises reacting an anionic synthetic organic detergent acid with a neutralizing agent for it in a reaction vessel in sufficient proportion to produce a corresponding neutralized detergent salt in liquid or slurry state, removing the neutralized detergent salt from the reaction vessel in such state and directly transferring it to a walled absorption zone interiorly of a particular carrier for it, so that the carrier helps to prevent contact of the detergent salt liquid or slurry with the surrounding absorption zone walls, and mixing the resulting particulate carrier containing absorbed detergent salt liquid or slurry, to produce a detergent salt-carrier composition in particulate form.

2. A process according to claim 1 wherein the anionic detergent acid is sodium linear $C_{12-13}$ alkylbenzene sulfonic acid, the neutralizing reaction is carried out in an aqueous liquid medium, in the reaction vessel, and the detergent salt in aqueous medium, is discharged from the reaction vessel directly into an absorption zone wherein particles of solid carrier material are circulated in a gaseous medium, onto which particles the neutralized detergent salt, in slurry state, is sprayed, and by which it is absorbed.

3. A process according to claim 2 wherein the detergent acid is sodium linear dodecylbenzene sulfonic acid, the neutralizing agent is an aqueous sodium hydroxide solution of about 50% sodium hydroxide concentration, in essentially stoichiometric proportion, the detergent salt is discharged from the reaction vessel into the absorption zone in aqueous solution at an elevated temperature, the gaseous medium is air, and the carrier material is selected from the group consisting of bentonite, zeolite, and water soluble inorganic builder salt.

4. A process according to claim 3 wherein the absorption zone is walled and the particulate carrier is bentonite powder, which is moved through the absorption zone about the sprayed detergent salt solution in such manner as to help prevent contact of detergent salt solution with the zone walls before absorption of the detergent salt solution by the bentonite.

5. A process according to claim 4 wherein the passage of materials through the absorption zone is substantially vertically downward, with movement thereof about a vertical axis, and the detergent salt-bentonite composition resulting is directly fed to an agglomerator, granulator or tumbling drum, in which it is conditioned or converted to bead form, of particle sizes in the range of No's. 4 to 120 sieves, U.S. Sieve Series, or is directly fed to a mixer from which it is subsequently fed to an agglomerator, granulator or tumbling drum, and is converted to such bead form and sizes.

6. A process according to claim 4 wherein the detergent salt-bentonite composition from the absorption zone is directly charged to a fluidized bed agglomerating zone through which air moves upwardly to the absorption zone and into which detergent salt-bentonite composition moves downwardly from the absorption zone.

7. A process according to claim 6 wherein the proportion of sodium linear dodecylbenzene sulfonate to bentionite is in the range of 1:3 to 1:4 and the beads resulting are of sizes in the range of No's. 10 to 100 sieves.

8. A process according to claim 1 wherein the particulate carrier is an inorganic builder salt.

9. A process according to claim 8 wherein the inorganic builder salt is sodium carbonate.

10. A process for manufacturing a particulate detergent composition which comprises reacting an anionic synthetic organic detergent acid with an excess of neutralizing particulate builder salt for such anionic synthetic organic detergent, in the presence of bentonite powder, in a walled absorption zone, by directing liquid state aqueous detergent acid into such zone interiorly of the builder salt and bentonite, which are directed into such zone exteriorly of the detergent acid, and mixing the acid, in droplets, and the builder particles together in such absorption zone by means of air movement therein, which inhibits contact of liquid state detergent acid with the absorption zone walls prior to contacting of such acid with such builder salt and bentonite particles, and prior to absorption of the neutralized detergent salt by the bentonite.

11. A process for manufacturing a particulate built detergent composition in a walled neutralizing zone which comprises reacting an anionic synthetic organic detergent acid with particulate sodium carbonate by spraying such liquid detergent acid as droplets into the interior of moving particulate sodium carbonate particles which are maintained in rotational movement between the detergent acid droplets and the wall of the neutralizing zone until substantially all of the detergent acid is neutralized by the sodium carbonate, resulting in particles of neutralized detergent salt with excess sodium carbonate thereon.

* * * * *